US010619379B2

(12) United States Patent
Baumhauer

(10) Patent No.: US 10,619,379 B2
(45) Date of Patent: Apr. 14, 2020

(54) KEY AND CORRESPONDING LOCK

(71) Applicant: EVVA Sicherheitstechnologie GmbH, Vienna (AT)

(72) Inventor: Walter Baumhauer, Vienna (AT)

(73) Assignee: EVVA Sicherheitstechnologie GmbH, Vienna (AT)

( * ) Notice: Subject to any disclaimer, the term of this patent is extended or adjusted under 35 U.S.C. 154(b) by 0 days.

(21) Appl. No.: 16/082,283

(22) PCT Filed: Mar. 10, 2017

(86) PCT No.: PCT/EP2017/055628
§ 371 (c)(1),
(2) Date: Sep. 5, 2018

(87) PCT Pub. No.: WO2017/153557
PCT Pub. Date: Sep. 14, 2017

(65) Prior Publication Data
US 2019/0093390 A1 Mar. 28, 2019

(30) Foreign Application Priority Data
Mar. 11, 2016 (AT) ..... A 50203/2016

(51) Int. Cl.
*E05B 27/00* (2006.01)
*E05B 19/00* (2006.01)
*E05B 27/10* (2006.01)

(52) U.S. Cl.
CPC ..... *E05B 27/0078* (2013.01); *E05B 19/0064* (2013.01); *E05B 27/0017* (2013.01);
(Continued)

(58) Field of Classification Search
CPC ..... E05B 27/0078; E05B 19/0058; E05B 19/0064; E05B 27/0017; E05B 27/0082;
(Continued)

(56) References Cited

U.S. PATENT DOCUMENTS 1,328,074 A * 1/1920 Bennett ..... E05B 29/00 70/492
2,023,207 A * 12/1935 Olson ..... E05B 29/00 70/406

(Continued)

FOREIGN PATENT DOCUMENTS

AT 389559 12/1989
AT 501706 10/2006

(Continued)

OTHER PUBLICATIONS

Internationaler Recherchenbericht und Schriftlicher Bescheid [International Search Report and the Written Opinion] Dated May 23, 2017 From the International Searching Authority Re. Application No. PCT/EP2017/055628 and Its Translation of Search Report Into English. (10 Pages).

*Primary Examiner* — Suzanne L Barrett

(57) ABSTRACT

The invention relates to a key (1) for locking a cylinder lock, comprising at least one first surface (2) and at least one second surface (2'), with sensing positions (4) provided along the longitudinal extent of the key (1), wherein at least one code (3) is provided on the first surface (2) and wherein at least one further code (3') is provided on the second surface (2'), the codes comprising control points (6, 6', 7, 7') at the sensing positions (4) that are provided transversely to the longitudinal extent of the key (1) and arranged at certain control heights (5), wherein at least at one sensing position (4) at least one control point (25, 25') has a different dimension, preferably a larger diameter, on the two surfaces than a control point (6, 6', 7, 7') at another sensing position (4). The invention also relates to a lock for such a key and a system made up of at least two locks and at least one key.

20 Claims, 10 Drawing Sheets

(52) U.S. Cl.
CPC ..... *E05B 27/0042* (2013.01); *E05B 27/0082* (2013.01); *E05B 2027/10* (2013.01)

(58) Field of Classification Search
CPC ..... E05B 27/0096; E05B 29/0066; E05B 27/0053; E05B 27/0085; E05B 47/0045; E05B 2047/10; E05B 2027/10
USPC ..... 70/491–496, 405, 406, 409
See application file for complete search history.

(56) References Cited

U.S. PATENT DOCUMENTS 3,035,433 A * 5/1962 Testa ..... E05B 29/00 70/495
3,264,852 A * 8/1966 Fritz ..... E05B 29/00 70/358
4,270,372 A * 6/1981 Vonlanthen ..... E05B 29/00 70/358
4,612,787 A * 9/1986 Prunbauer ..... E05B 19/0017 70/358
4,977,767 A * 12/1990 Prunbauer ..... E05B 27/0082 70/406
5,349,830 A * 9/1994 Keller ..... E05B 19/0023 70/358
5,797,287 A * 8/1998 Prunbauer ..... E05B 27/0042 70/409
5,956,986 A * 9/1999 Vonlanthen ..... E05B 27/0035 70/492
7,207,200 B2 * 4/2007 Eden, Jr. ..... E05B 27/00 70/358
8,726,706 B2 * 5/2014 Jacob ..... E05B 19/0017 70/356
8,826,707 B2 * 9/2014 Habecke ..... E05B 19/0017 70/357
2003/0089149 A1 * 5/2003 Suzuki ..... E05B 29/004 70/492
2003/0101783 A1 * 6/2003 Kleinhani ..... E05B 17/0004 70/409
2006/0236733 A1 * 10/2006 Walter ..... E05B 27/0078 70/495
2011/0126600 A1 * 6/2011 Baumhauer ..... E05B 19/0023 70/374
2011/0302972 A1 * 12/2011 Higuchi ..... E05B 29/00 70/491

FOREIGN PATENT DOCUMENTS

AT 516237 3/2016
EP 0613987 9/1994
EP 1712714 10/2006

* cited by examiner

KEY AND CORRESPONDING LOCK

RELATED APPLICATIONS

This application is a National Phase of PCT Patent Application No. PCT/EP2017/055628 having International filing date of Mar. 10, 2017, which claims the benefit of priority of Austrian Patent Application No. A50203/2016 filed on Mar. 11, 2016. The contents of the above applications are all incorporated by reference as if fully set forth herein in their entirety.

FIELD AND BACKGROUND OF THE INVENTION

The invention relates to a key for locking a cylinder lock, having at least one first surface and at least one second surface and sensing positions provided along the longitudinal extent of the key, wherein at least one code is provided on the first surface and wherein at least one further code is provided on the second surface, the codes comprising control points at the sensing positions that are provided transversely to the longitudinal extent of the key and arranged at certain control heights. The invention also relates to a cylinder lock for a key of this type, and a system made up of a cylinder lock of this type and a key of this type.

Keys with two encoded surfaces which are configured as reversible keys are known from the prior art. Reversible keys are keys, the shaft of which has uniformly arranged profiles, guiding grooves, depressions, elevations or/and notches on both sides. When rotated about its longitudinal axis, a reversible key in each case has the same features thereof and can, therefore, —independently of the side of the key which is pointing upwards—also be introduced into the keyway of the associated lock cylinder in a rotated fashion, which is not possible in the case of a normal key with notches on one side.

As the codes on reversible keys are identical on both sides, the codes are usually read on each side alternately in the lock, in order to reduce the number of sensing elements. In this context, the term "identical codes" means that the codes are the same on the respectively considered surfaces when the key is rotated about its longitudinal axis.

In reversible keys of this type, however, the depiction of one side is sufficient in order to be able to reproduce the key. This is disadvantageous with regard to modern reproduction methods (high-resolution smartphone cameras in combination with 3D printing), as illegal keys can easily be brought into circulation.

Furthermore, in the case of reversible keys with laterally arranged control points, the problem emerges that the control points on both sides of the key must be identical in the sense of the above definition. However, limitations for the realization of the control points at the key tip result: The central position of the tumbler at the key tip cannot be used, as there would otherwise be an increased danger of breakage.

SUMMARY OF THE INVENTION

It is an object of the invention to overcome these and further problems of conventional keys and locks. In particular, a new key and a new lock shall be realized which offer sufficient possible combinations and are hard to copy. In particular, the invention is meant to solve the problem that presents the ease with which reversible keys can be copied.

It is furthermore intended to provide a possibility to lock a plurality of different reversible key locking systems using the same key.

Another object of the invention is to overcome the above described limitation regarding the lateral code on the key tip. In addition, it is aimed at increasing the variation options on the key and at ensuring greater locking security. Furthermore, an aim is to achieve identical effects with regard to the new construction of the lock. Another object is to solve the problem that existing keys can lock new locking systems unless both surfaces of the key are read by these new locking systems.

These and further objects are achieved according to the invention by a key with the features disclosed in claim 1.

By providing, according to the invention, at least at one sensing position at least one control point with different dimensions, preferably a larger diameter, on the two surfaces, compared to a control point at another sensing position, the number of possible combinations of the key is increased.

Another advantage is that the new locks constructed for this key cannot be actuated using known reversible keys, which are not configured for reading the differently dimensioned control point.

This also applies if the locks produced for the new key do not even read all the sensing positions on both sides of the key, but read—as they have done so far—only every other sensing position alternately on each side. By providing the control points at one of the sensing positions with different dimensions on the two sides, preferably a larger diameter on one side, it is ensured that existing locks cannot be actuated using this key.

The invention may in particular provide that the codes of the two surfaces are different in lock-technical terms at least at one sensing position on the key and that the codes of the two surfaces are identical in lock-technical terms at least at one sensing position.

This embodiment according to the invention solves several problems. The first advantage is that it makes unauthorized copying of the key considerably more difficult as the codes on the two surfaces of the key are different.

In addition, the solution according to the invention makes it possible to lock one or more locking cylinders of a locking system with one key, which, after being rotated 90° to 180° about its longitudinal axis, also locks one or more locking cylinders of another locking system.

In this case, it may be provided that a key, which has the same codes on both sides, does not have locking authorization. It may, however, also be provided that a key, which has the same codes on both sides, does have locking authorization.

One advantage of the solution according to the invention is that the feature for the authorization to lock a plurality of locking cylinders does not have to be incorporated into the locking cylinder of the locking systems, but is realized with at least two or more features on different surfaces of the key itself. As a result, a key can be designed, which has a superordinate function in two different reversible key locking systems, but does not have the reversible key function itself.

This may, for example, be a superordinate key for authorized persons, such as fire brigades, night watchmen, home care personnel or the like.

A further advantage of the solution according to the invention, when designing the key with curve codes, is that due to the differently shaped curves on the two sides of the key, the central tumbler at the key tip can now also be used, as it does not have to be milled on both sides in the form of a groove.

One sensing position may also present a plurality of codes, of which one or more is/are realized identically on all surfaces of the key and one or more is/are realized differently on at least one surface of the key.

The invention may provide that further codes are provided on the two surfaces of the key and/or at other locations of the key.

The invention may provide that the control points and/or further codes at other locations of the key essentially comprise rectilinear, angled, circular or bent, horizontally or vertically extending grooves, channels, milled sections, notches or elevations, control surfaces, control paths, recesses, drilled recesses with identical or different diameters and/or depths, mounted balls, circular or elliptical segment recesses, spherical-segment-shaped elevations or recesses, magnetic codes, electronic codes and/or combinations of these elements.

The invention may provide that the surfaces are the key flat sides. The invention may likewise provide that the surfaces are the key narrow sides. The invention may provide that the first surface is a key narrow side and the second surface is a key flat side. The second surface may enclose an arbitrary angle, particularly approximately 90° or approximately 180°, with the first surface of the key.

The invention may provide that the control points are connected to one another by means of control grooves.

The invention may provide that at least six sensing positions A-F are provided in the longitudinal direction of the key and that at least six control heights a-f are provided in the transverse direction of the key.

The invention may provide that at least three control grooves are provided, of which at least one is constructed as a deep control groove with deep control points, and the remaining control grooves are constructed as shallow control grooves with shallow control points, the deep control grooves having a larger groove depth than the shallow control grooves, and the shallow control grooves extending essentially parallel to one another.

The invention may provide that at least three, preferably five, control heights are provided for at least one control groove, preferably for the shallow control grooves.

The invention may provide that the codes are initially realized identically from a key tip of the key towards a key bow of the key and that they are realized differently, preferably continuously differently, from a certain sensing position onwards.

The invention may provide that the deep control groove or the shallow control grooves, starting from the key tip towards the key bow, only extend up to a certain sensing position, while the respective other control grooves extend beyond it.

The invention may provide that the differently dimensioned control point is located at the first sensing position from the key tip of the key towards the key bow.

In particular, the differently dimensioned control point can have a larger diameter than the control points at the other sensing positions.

In particular, the differently dimensioned control point can be part of the deep control grooves.

In particular, the diameter of the differently dimensioned control point can be about 10% to about 40% larger than the diameter of the other control points.

The invention may also provide that the deep control grooves are located between the shallow control grooves at the key tip and that they merge so that no separating bar of material remains between the deep and the shallow control grooves at the key tip. The introduction of the lock's control elements into the respective control grooves of the key is thus facilitated: The control elements of the lock are distributed to the corresponding control grooves of the key from a shallower broader groove into two shallow control grooves and from a narrower deeper groove into a narrowing deep groove between the two shallow grooves.

According to the invention, two grooves with different depths and widths can thus be provided at the key tip, the grooves being realized to distribute three different control organs of the cylinder lock to two shallow and one deep control groove, the deep control groove tapering from the key tip towards the key bow. According to the invention a preferably funnel-shaped inlet area can thus be formed at the key tip.

The invention may provide that the deep control groove is realized as a deep control groove with a larger diameter from the key tip to the control point with the larger diameter. The diameter of the deep control groove can be substantially equal to the diameter of the control groove with the larger diameter.

The invention also extends to a cylinder lock for a key according to the invention, comprising a keyway with at least two sides with sensing positions provided along the longitudinal extent, wherein at least one control element with control organs for engaging at least one code on at least one surface of the key is provided at each sensing position, wherein at least one locking element is provided, which, given an appropriate position of the control element, can be brought into a release position for actuating the lock.

The invention provides that the control organs of the cylinder lock have at least at one sensing position a different dimension, preferably a larger width, compared to the other sensing positions. The technical result of this is that the above described keys, which are provided with a differently dimensioned control point, can be read. These differently dimensioned control organs can preferably be provided on one side of the keyway only.

The invention may provide that control elements are provided at least at a first sensing position on two sides of the keyway for reading different codes on two surfaces of the key and that control elements are provided at a second sensing position on two sides of the keyway for reading identical codes on two surfaces of the key.

The invention may provide that the control elements comprise first control organs for engaging deep control grooves and second control organs for engaging shallow control grooves.

The invention may provide that the control elements for controlling the locking elements are provided with engaging means, particularly one or more reading grooves, which interact with the locking element in one or more positions of the control element in such a manner that the same can be brought into a release position for actuating the lock.

According to the invention, the differently dimensioned control organs can in particular be arranged at the last sensing position as seen from a core head of the cylinder lock. In this way, the differently dimensioned control organs communicate with the differently dimensioned control points of a key according to the invention.

The invention also extends to a system made up of at least two locks or groups of locks according to the invention and at least one associated key according to the invention, wherein at least one first lock or a first lock group reads at least only the first code on the first surface at least at one specific sensing position, and at least one second lock or a second lock group reads at least only the second code on the second surface of the key at the same sensing position, so that the key locks the first lock or the first lock group in a first position and locks the second lock or the second lock group in a second position.

Further features according to the invention result from the description of the exemplary embodiments, the patent claims and the drawings.

DESCRIPTION OF SPECIFIC EMBODIMENTS OF THE INVENTION

Figure 1A:
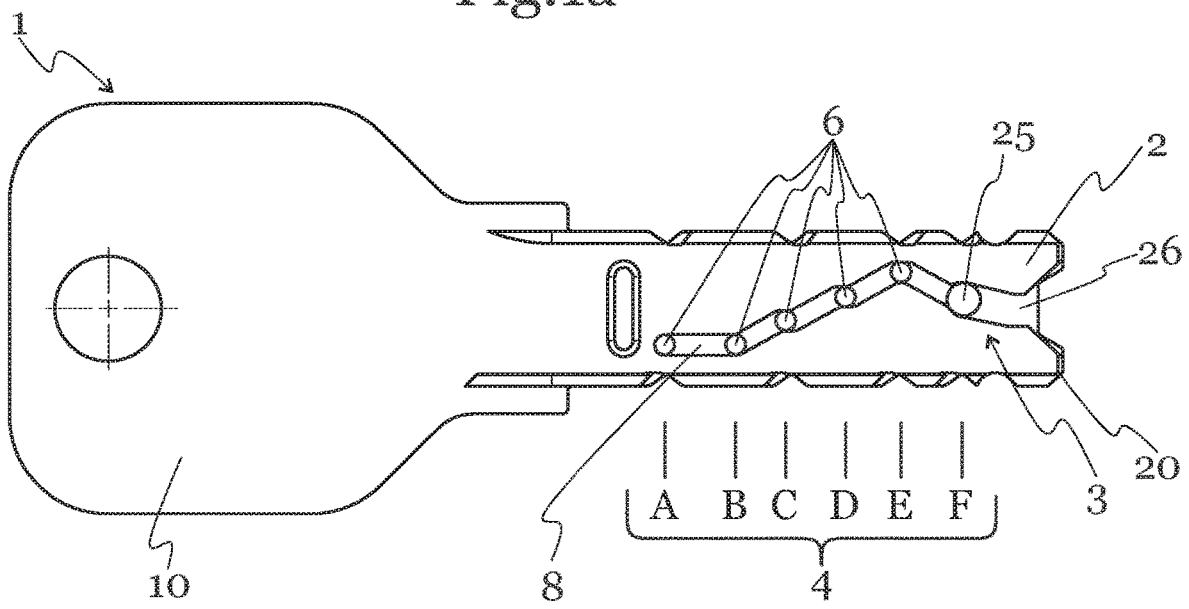
FIGS. 1*a* and 1*b* show an exemplary embodiment of a key 1 according to the invention.
Figure 1B:
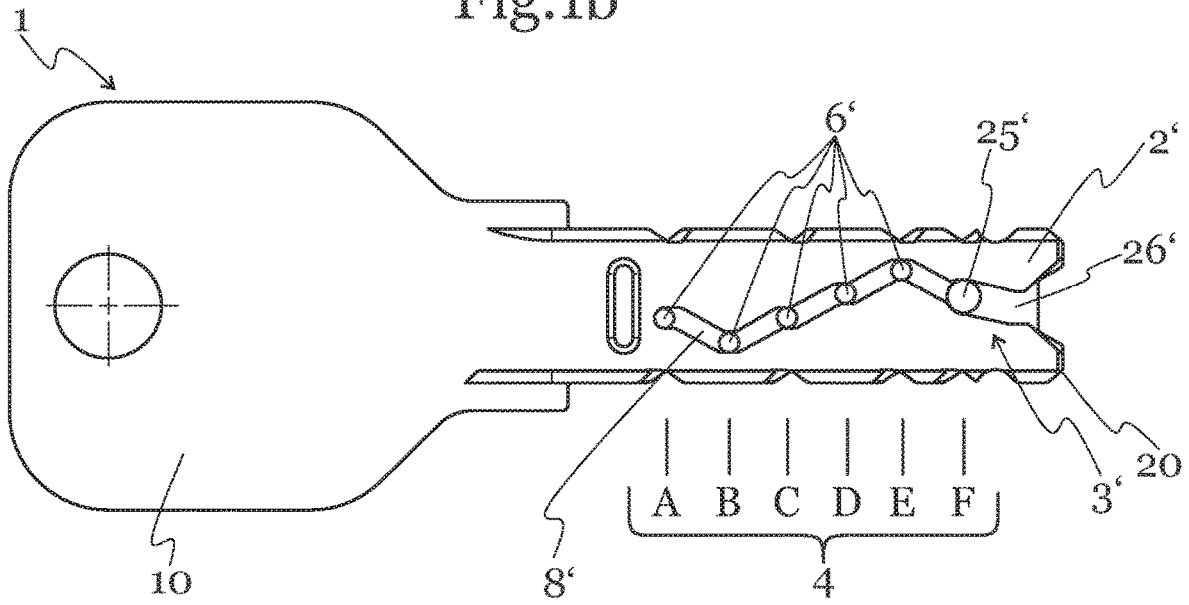

The invention is explained in more detail in the following on the basis of non-limiting exemplary embodiments:

FIGS. 1*a*-1*b* show an exemplary embodiment of a key 1 according to the invention, which is realized as a flat key with a key bow 10 and a key tip 20 and two opposite surfaces 2, 2'. FIG. 1*a* shows a view of the first surface 2, FIG. 1*b* shows a view of the second surface 2'. The surfaces 2, 2' are the key flat sides.

Sensing positions 4, namely six sensing positions A-F, are provided for both surfaces 2, 2' along the longitudinal extent of the key 1. A code 3, 3' is located at each sensing position 4 on both surfaces 2, 2' of the key 1, wherein the first code 3 is provided on the surface 2 and the second code 3' is provided on the surface 2'. The codes 3, 3' comprise control points 6, 6' which are arranged at certain control heights and are connected to one another by means of control grooves 8, 8'.

The control points are realized differently on the sensing position A, and identically on the sensing positions B-F. Therefore, a lock which only reads one side of the key can only be actuated in one position of the key. In order to be able to read both codes at the sensing position A, the lock has to be realized in such a manner that it reads both surfaces 2, 2' of the key 1 independently of one another at least at the sensing position A.

The control point 25, 25' at the sensing position F at the tip of the key has a larger diameter than the control points at the other sensing positions of the key. From the control point 25, 25' to the key tip 20 the deep control groove 8, 8' is realized as deep control groove with a larger diameter 26, 26'.

Figure 2A:
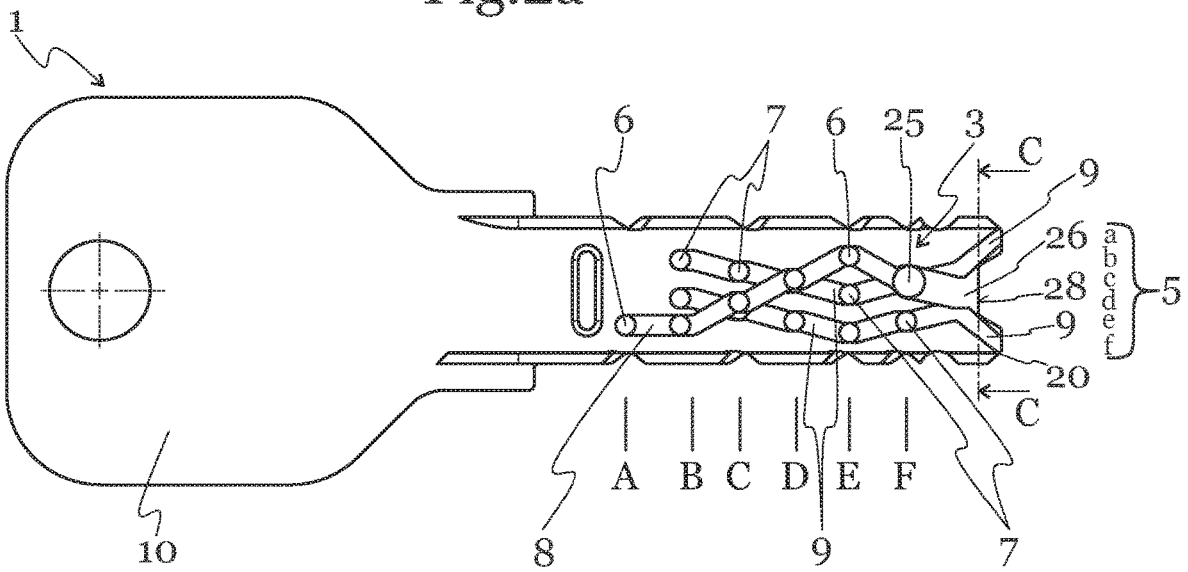
FIGS. 2*a* and 2*b* show a further exemplary embodiment of a key 1 according to the invention.
Figure 2B:
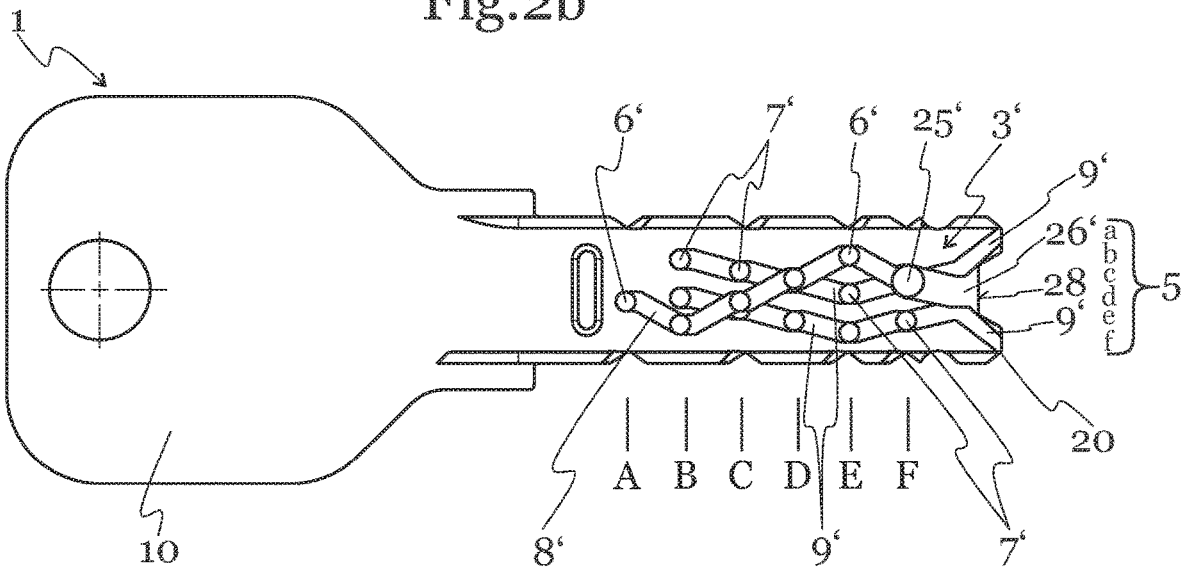

FIGS. 2*a*-2*b* show a further exemplary embodiment of a key 1 according to the invention, which is realized as a flat key with a key bow 10 and a key tip 20 and two opposite surfaces 2, 2'. The surfaces 2, 2' are again the key flat sides 16, 16'.

Sensing positions 4, namely six sensing positions A-F, 4 are provided for both surfaces 2, 2' along the longitudinal extent of the key 1. A code 3, 3' is located at each sensing position 4 on both surfaces 2, 2' of the key 1, wherein the first code 3 is provided on the surface 2 and the second code 3' is provided on the surface 2'.

The codes are realized differently on the sensing position A, and identically on the sensing positions B-F.

The codes 3, 3' comprise deep control points 6, 6' and shallow control points 7, 7' which are connected to one another by means of a deep control groove 8, 8' and two shallow control grooves 9, 9' respectively. The deep control grooves 8, 8' have a larger groove depth than the shallow control grooves 9, 9'. The shallow control grooves 9, 9' extend substantially parallel to one another.

The control points 6, 6', 7, 7' are arranged at the reading positions at control heights 5 provided transversely to the longitudinal extent of the key 1. Six control heights a-f are provided in this exemplary embodiment.

While the control points 6, 6', 7, 7' at the sensing positions B-F are identical on both surfaces 2, 2' of the key 1, the deep control point 6, 6' is arranged at a different control height 5 on the two surfaces 2, 2' at the sensing position A.

A control point 25, 25' at the sensing position F at the tip of the key has again a larger diameter than the control points at the other sensing positions of the key. From the control point 25, 25' to the key tip 20 the deep control groove 8, 8' is again configured as deep control groove with a larger diameter 26, 26'.

Figure 2C:
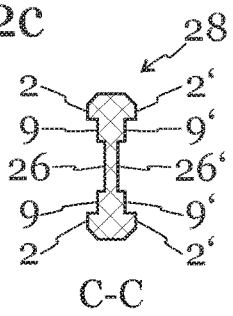
Figure 3A:
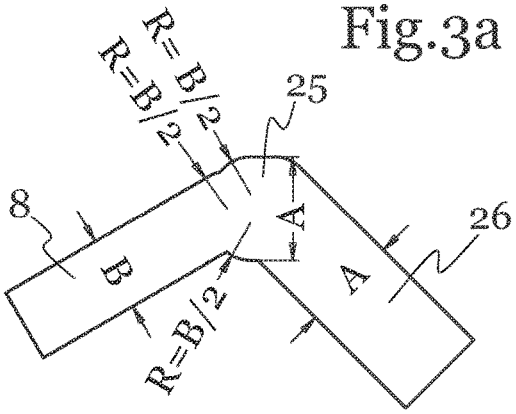
FIGS. 3*a*, 3*b*, 3*c*, 3*d*, 3*e* and 3*f* show a detailed illustration of different embodiments.
Figure 3B:
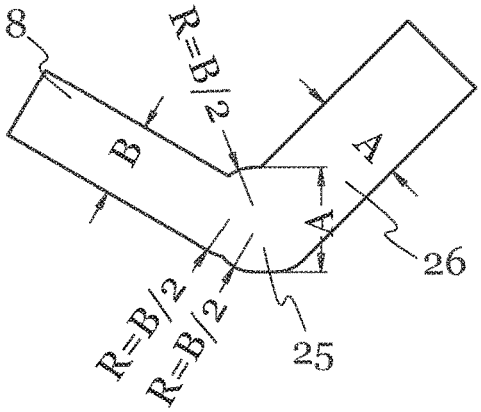
Figure 3C:
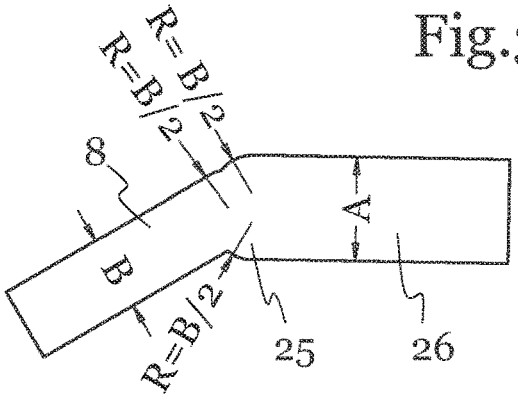
Figure 3D:
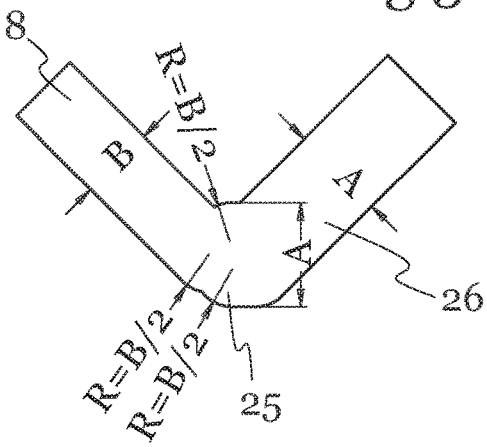
Figure 3E:
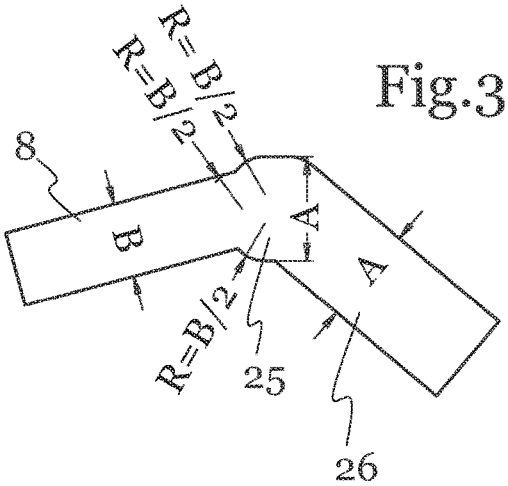
Figure 3F:
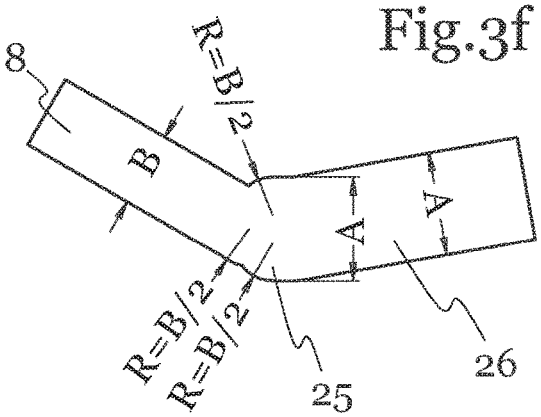

In this exemplary embodiment the deep control grooves at the key tip 20 are arranged between the shallow control grooves and merge with them so that no separating bar of material remains at the key tip 20 between the deep control grooves with the larger diameter 25, 25' and the shallow control grooves 9, 9'. FIG. 2*c* schematically shows the inlet area 28, presenting a cut along the line C-C: The funnel-shaped inlet area 28 at the key tip 20 tapers towards the middle axis of the key and is, therefore, funnel-shaped. The correct arranging of the lock's control organs into the respective control grooves of the key is thus facilitated.

FIGS. 3*a*-3*f* show a detailed illustration of different embodiments of the broadened control point 25 and the deep control groove 8 and the control groove with the larger diameter 26 at the sensing position F at the key tip. As the illustration shows, the broadened control point 25 is provided with outer radii, which equal half the diameter B of the deep control groove 8. The illustration also shows that the diameter A of the control groove with the larger diameter 26 is about 10% to 40% larger than the diameter B of the deep control groove 8. At the indicated location, the broadened control points 25 have a diameter that approximately equals the diameter A of the control groove with the larger diameter 26.

Figure 4C:
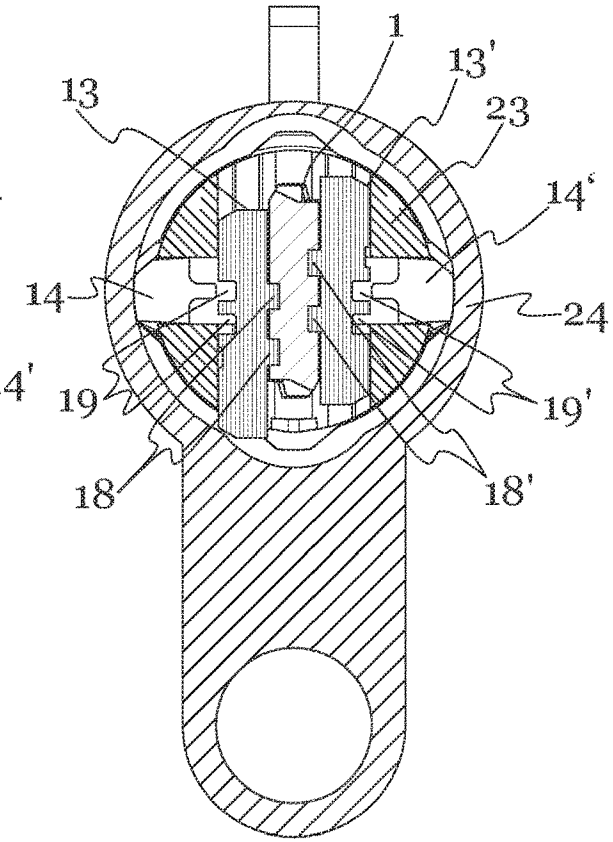
FIGS. 4*a*, 4*b* and 4*c* show cross sections through exemplary embodiments of key/lock combinations according to the invention.
Figure 4B:
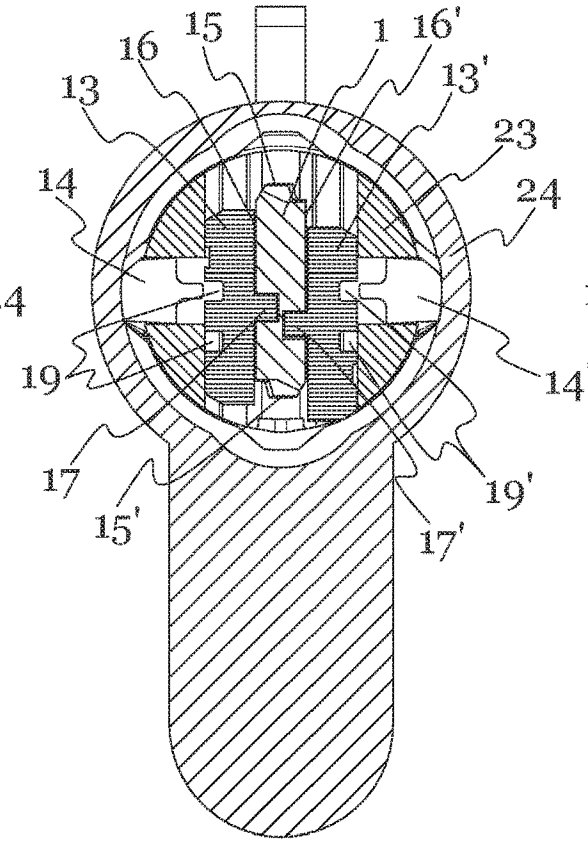
Figure 4A:
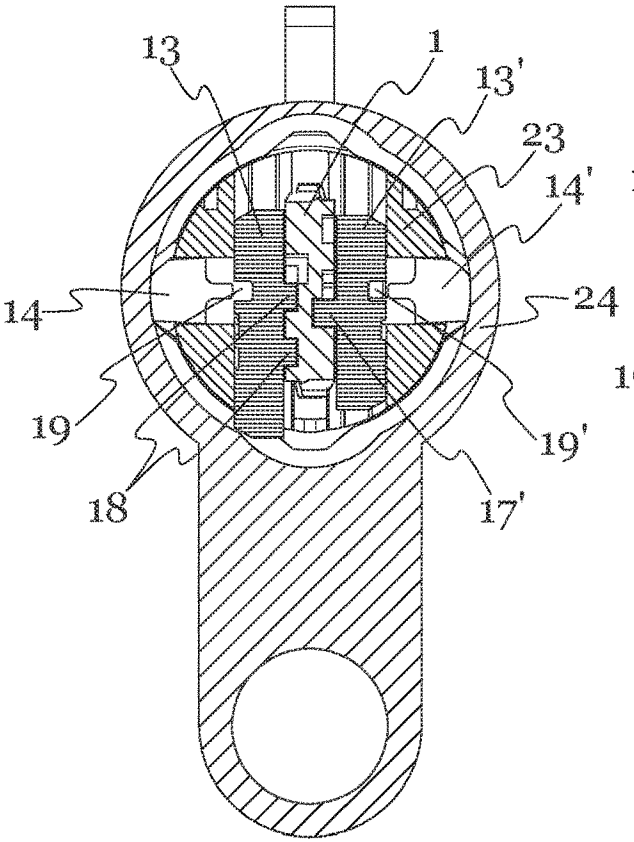

FIGS. 4*a*-4*c* show cross sections through exemplary embodiments of key/lock combinations according to the invention. FIG. 4*a* shows a cross section through a cylinder lock with a core 23, which is rotatably mounted in a housing 24. A key 1 is introduced into the keyway. Control elements 13, 13' are arranged in a displaceable manner on both sides of the keyway at the shown sensing position, wherein the control elements interact with locking elements 14, 14', which engage housing grooves. On one side of the key 1, the cylinder lock reads the two shallow grooves using the control organs 18 and on the other side of the key 1, it reads the deep groove using the control organ 17'. The position of the deep groove on surface 2 and the shallow grooves on side 2' is not read, as it is assumed—owing to the reversible key system—that the codes are the same on both surfaces 2, 2'.

FIG. 4*b* shows a cross section through the exemplary embodiment at another sensing position. In this case, the codes in the form of deep grooves on the surfaces 2, 2' of the key are different and are also read independently of one another on both sides of the key. In order to be able to read both codes on each surface 2, 2', the locking elements 13, 13' engage the deep groove on both sides via first control organs 17, 17'. However, as the deep groove is at a different position depending on the rotation of the key 1, the control elements 13, 13' each have two reading grooves 19, 19' for engaging the locking elements 14, 14'. Therefore, the locking elements 14, 14' are activated in two different positions of the control elements 13, 13' in each case and lock the lock. Although the key 1 is not a reversible key—as the codes on surface 2 and 2' are different—it functions as a reversible key, as both surfaces of the key are read in both positions.

FIG. 4*c* shows an analogous embodiment to FIG. 4*b* with the difference that at the illustrated sensing position of the key 1, the code is not realized by one deep groove per surface 2, 2', but rather by two shallow grooves 2, 2' per surface. The control elements 13, 13' have two control organs 18, 18' each for engaging the shallow grooves and two reading grooves 19, 19' each for engaging the locking elements 14, 14'.

Hence, the locking elements 14, 14' are activated, as in the exemplary embodiment in FIG. 4*b*, in two different positions of the control elements 13, 13' in each case and lock the lock, even though the key is not a reversible key.

In an exemplary embodiment which is not illustrated, the lock is provided with a further mechanical reading logic, particularly of the locking elements 14, 14', which ensures that the lock in FIG. 2*b* or FIG. 2*c* cannot be locked by a conventional reversible key with identical codes on the surfaces 2, 2', but can exclusively be locked using keys with different codes.

Figure 5A:
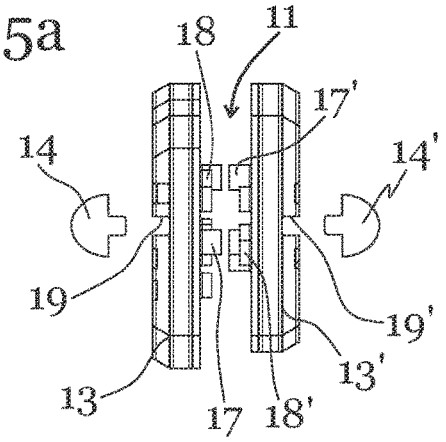
FIGS. 5*a* and 5*b* show a schematic illustration of the tumblers within the cylinder core of a lock according to the invention.
Figure 5B:
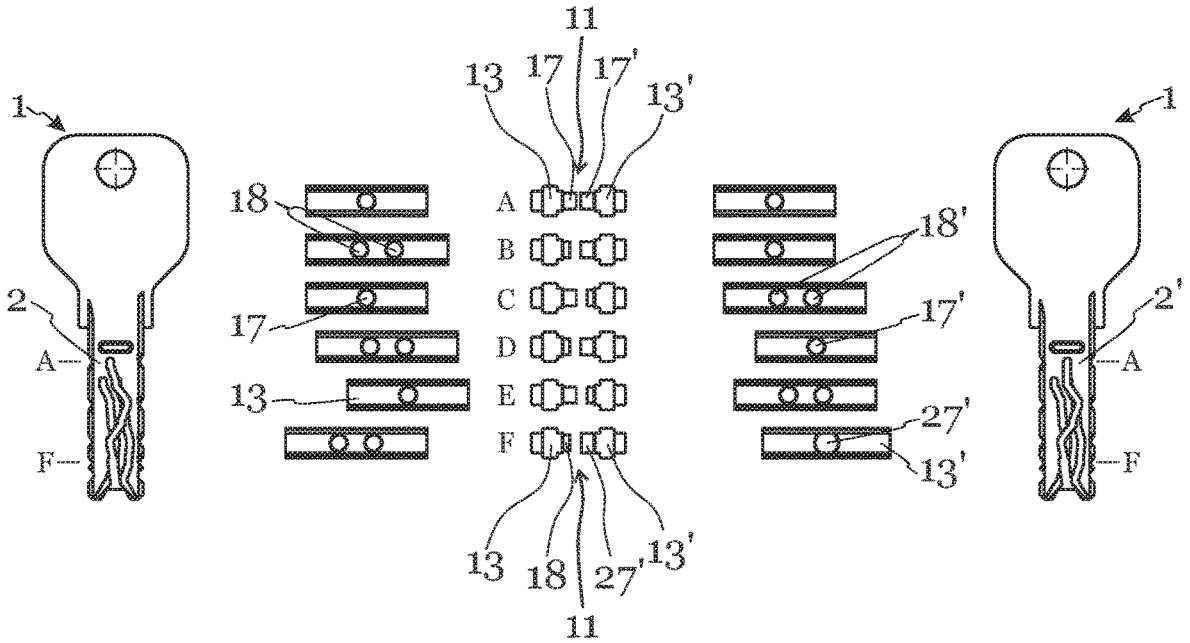

FIGS. 5*a*-5*b* show a schematic illustration of the tumblers within the cylinder core of a lock according to the invention, wherein the key and cylinder core and housing have not been illustrated in FIG. 5*a* for reasons of clarity. FIG. 5*a* shows a view into the keyway 11 and shows the control elements 13, 13', which read the keyway by means of control organs 17, 17', 18, 18'. The control elements 13, 13' have reading grooves 19, 19' on the sides, which interact with locking elements 14, 14'.

In FIG. 5*b*, a top view of the keyway 11 is illustrated in FIG. 5*b*, and the sensing positions A-F are illustrated. At each sensing position, two control elements 13, 13' are located on both sides of the keyway 11, which have first control organs 17, 17' for reading the deep grooves on the key, second control organs 18, 18' for reading the shallow grooves of the key or control organs with a larger diameter 27, 27'. To the right and left of the keyway 11, the control elements 13, 13' are illustrated once more in a position rotated by 90°. This exemplary embodiment of the lock is realized for a key as illustrated schematically, the deep control groove 8, 8' extending over the entire length of the key shaft and the shallow control grooves 9, 9' being provided solely at the sensing positions B-F.

Apart from the control organs 17, 17' for reading the deep control grooves and the control organs 18, 18' for reading the shallow control grooves, a control organ with a larger diameter 27 is provided on one side of the keyway 11 for reading the control points with the larger diameter 25 at the sensing position F.

At the sensing position F, the control organ 27 has thus a larger diameter for reading the deep control groove than the control organs at the other sensing positions.

Figure 6A:
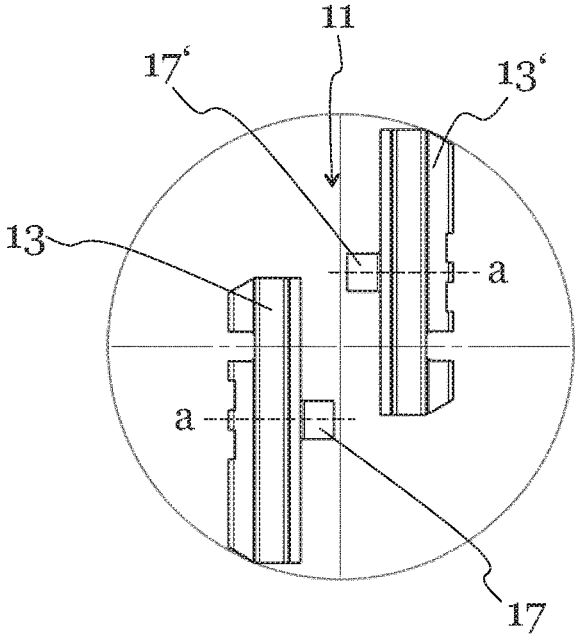
FIG. 6*a* shows a schematic view of a keyway.
Figure 6B:
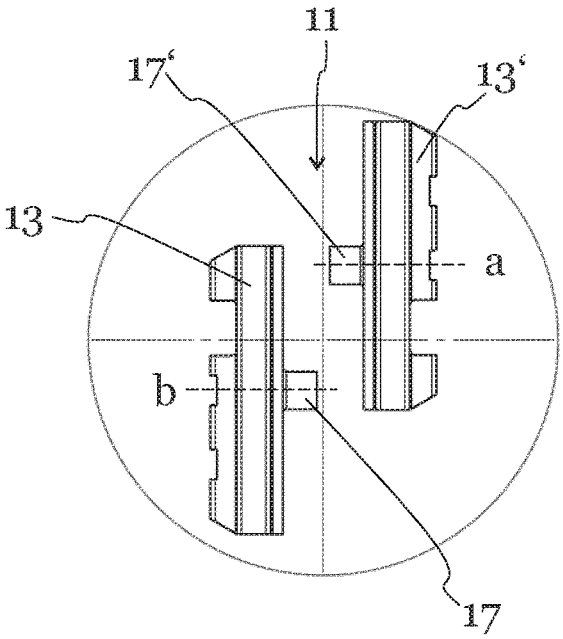
FIGS. 6*b*, 6*c*, 6*d*, 6*e*, 6*f* and 6*g* show possible combined features at those sensing positions at which the codes of the two surfaces of the key differ in lock-technical terms.
Figure 6C:
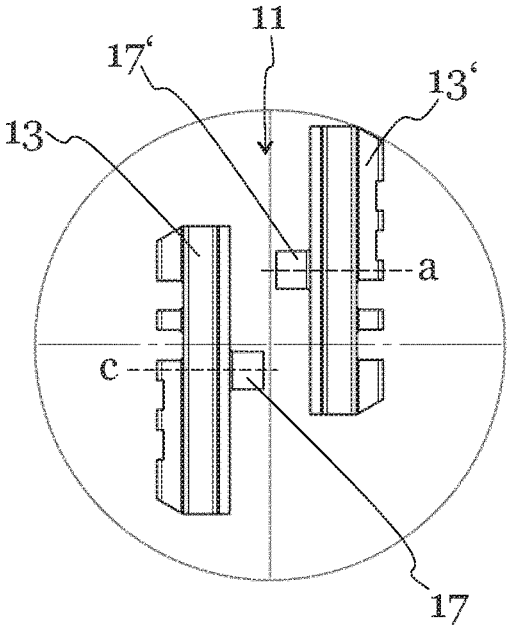
Figure 6D:
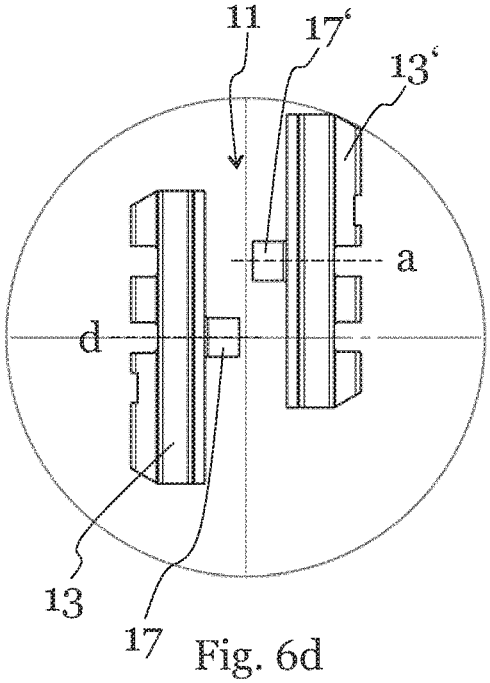
Figure 6E:
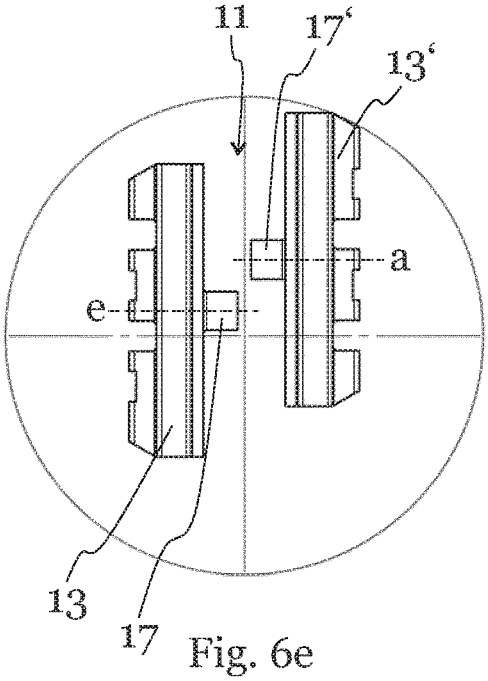
Figure 6F:
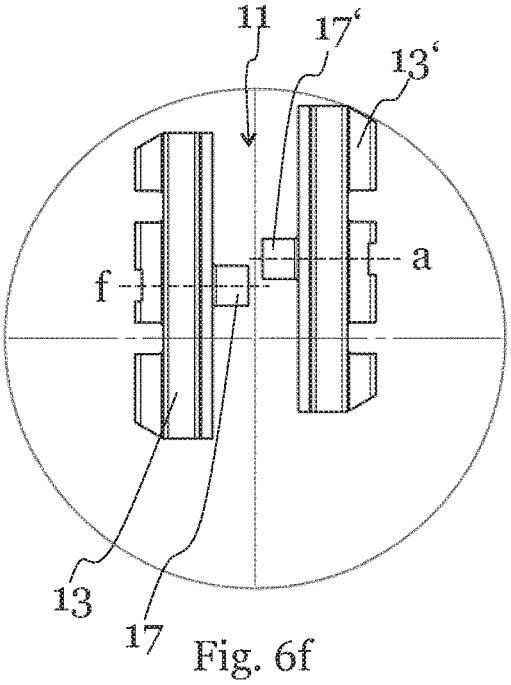
Figure 6G:
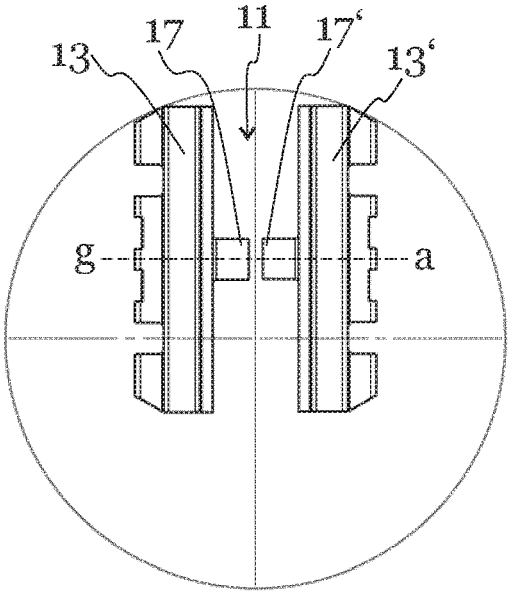

One embodiment of the key according to which the codes of the two surfaces of the key are different in lock-technical terms at least at one sensing position allows combined features to be considered at least at this sensing position when designing the codes. To illustrate this advantage according to the invention, FIG. 6*a* shows a schematic view of a keyway 11 with control elements 13, 13' with control organs 17, 17' being arranged to the left and right of the keyway 11 and as being in a release position. At the shown sensing position, the codes of the two surfaces of the key are identical so that the left control element 13 as well as the right control element 13' have to be located at the same control height—in this specific example at the control height a.

FIG. 6*b*-6*g* show possible combined features at those sensing positions at which the codes of the two surfaces of the key differ in lock-technical terms. In these figures, the right control element 13' is located at the control height a at all times, while the control height of the left control element 13 varies from control height b in FIG. 6*b* to control height g in FIG. 6*g*.

Hence, with an appropriate number of control heights, multiple combined features result, which allow additional variations of the key codes compared to common reversible keys.

For example, if only two control heights a, b are provided on each side of the keyway and if the codes of the two surfaces of the key may differ in lock-technical terms, there is one more possible way of arranging the control elements compared to the reversible key, namely the arrangement in which the left control element 13 at control height a and the right control element 13' at control height b are in a release position. This arrangement would not be possible in a common reversible key.

Three control heights a, b, c provided on each side of the keyway already yield three additional possible ways of arranging the control elements. These possible combinations can be systematically described as follows, wherein S1 describes the left control element 13, S2 the right control element 13' and the number after the forward slash describes the control height.

One control height each: No additional combination feature.

Two control heights each: S1/1+S2/2 yields one additional feature (left control element at control height a, right control element at control height b).

Three control heights each:

S1/1+S2/2 (left control element at control height a, right control element at control height b), S1/2+S2/3 (left control element at control height b, right control element at control height c), S1/1+S2/3 (left control element at control height a, right control element at control height c), This leads to three additional features in total.

Four control heights each:

| | | |
|---|---|---|
| S1/1 + S2/2 | S1/2 + S2/3 | S1/3 + S2/4 |
| S1/1 + S2/3 | S1/2 + S2/4 | |
| S1/1 + S2/4 | | |

This leads to six additional features in total.
Five control heights each:

| | | | |
|---|---|---|---|
| S1/1 + S2/2 | S1/2 + S2/3 | S1/3 + S2/4 | S1/4 + S2/5 |
| S1/1 + S2/3 | S1/2 + S2/4 | S1/3 + S2/5 | |
| S1/1 + S2/4 | S1/2 + S2/5 | | |
| S1/1 + S2/5 | | | |

This leads to ten additional features in total.
Six control heights each:

| | | | | |
|---|---|---|---|---|
| S1/1 + S2/2 | S1/2 + S2/3 | S1/3 + S2/4 | S1/4 + S2/5 | S1/5 + S2/6 |
| S1/1 + S2/3 | S1/2 + S2/4 | S1/3 + S2/5 | S1/4 + S2/6 | |
| S1/1 + S2/4 | S1/2 + S2/5 | S1/3 + S2/6 | | |
| S1/1 + S2/5 | S1/2 + S2/6 | | | |
| S1/1 + S2/6 | | | | |

This leads to fifteen additional features in total.
Seven control heights each:

| | | | | | |
|---|---|---|---|---|---|
| S1/1 + S2/2 | S1/2 + S2/3 | S1/3 + S2/4 | S1/4 + S2/5 | S1/5 + S2/6 | S1/6 + S2/7 |
| S1/1 + S2/3 | S1/2 + S2/4 | S1/3 + S2/5 | S1/4 + S2/6 | S1/5 + S2/7 | |
| S1/1 + S2/4 | S1/2 + S2/5 | S1/3 + S2/6 | S1/4 + S2/7 | | |
| S1/1 + S2/5 | S1/2 + S2/6 | S1/3 + S2/7 | | | |
| S1/1 + S2/6 | S1/2 + S2/7 | | | | |
| S1/1 + S2/7 | | | | | |

This leads to 21 additional features in total.
Eight control heights each:

| | | | | | |
|---|---|---|---|---|---|
| S1/1 + S2/2 | S1/2 + S2/3 | S1/3 + S2/4 | S1/4 + S2/5 | S1/5 + S2/6 | S1/6 + S2/7 |
| S1/7 + S2/8 | | | | | |
| S1/1 + S2/3 | S1/2 + S2/4 | S1/3 + S2/5 | S1/4 + S2/6 | S1/5 + S2/7 | S1/6 + S2/8 |
| S1/1 + S2/4 | S1/2 + S2/5 | S1/3 + S2/6 | S1/4 + S2/7 | S1/5 + S2/8 | |
| S1/1 + S2/5 | S1/2 + S2/6 | S1/3 + S2/7 | S1/4 + S2/8 | | |
| S1/1 + S2/6 | S1/2 + S2/7 | S1/3 + S2/8 | | | |
| S1/1 + S2/7 | S1/2 + S2/8 | | | | |
| S1/1 + S2/8 | | | | | |

This leads to 28 additional features in total.
Nine control heights each:

| | | | | | |
|---|---|---|---|---|---|
| S1/1 + S2/2 | S1/2 + S2/3 | S1/3 + S2/4 | S1/4 + S2/5 | S1/5 + S2/6 | S1/6 + S2/7 |
| S1/7 + S2/8 | S1/8 + S2/9 | | | | |
| S1/1 + S2/3 | S1/2 + S2/4 | S1/3 + S2/5 | S1/4 + S2/6 | S1/5 + S2/7 | S1/6 + S2/8 |
| S1/7 + S2/9 | | | | | |
| S1/1 + S2/4 | S1/2 + S2/5 | S1/3 + S2/6 | S1/4 + S2/7 | S1/5 + S2/8 | S1/6 + S2/9 |
| S1/1 + S2/5 | S1/2 + S2/6 | S1/3 + S2/7 | S1/4 + S2/8 | S1/5 + S2/9 | |
| S1/1 + S2/6 | S1/2 + S2/7 | S1/3 + S2/8 | S1/4 + S2/9 | | |
| S1/1 + S2/7 | S1/2 + S2/8 | S1/3 + S2/9 | | | |
| S1/1 + S2/8 | S1/2 + S2/9 | | | | |
| S1/1 + S2/9 | | | | | |

This leads to 36 additional features in total.

In case a single curve as well as a double curve is read on each side of the key, the single curve 9 and the double curve 7 being provided with control heights, the number of possible reading positions for each pin pair is even 16.

FIGS. 7*a*-7*d* show further embodiments of keys 1 according to the invention and respective locks. A top view of the keyway 11 with the sensing positions A-F is shown, the core head of the locking cylinder being located at the top, i.e. in the area of the sensing position A, respectively. In this view, a key according to the invention is thus introduced into the lock from above.

Control elements 13, 13' are located on both sides of the keyway at each sensing position A-F, wherein the control elements either have first control organs 17, 17' for reading the deep grooves on the key, second control organs 18, 18' for reading the shallow grooves or control organs with a larger diameter 27, 27'. To the right and left of the keyway 11, the control elements 13, 13' are illustrated in a position rotated by 90°. The correspondingly realized key is shown schematically in FIGS. 7*c* and 7*d* to the right and the left of the keyway 11 in each case, a control point with a larger diameter 25, 25' being provided at the sensing position F at the key tip on both sides 2, 2' of the key.

On the key in the illustrated embodiments, a deep control groove 8, 8', two shallow control grooves 9, 9' as well as a control point with a larger diameter 25, 25' are provided at the sensing position F at the tip of the key. As shown in FIGS. 2*a*-2*b* and 3*a*-3*f*, the control point with the larger diameter 25, 25' is part of a deep control groove with a larger diameter 26, 26' respectively, which merges with the deep control groove 8, 8' from the sensing position F onwards.

Accordingly, each of the three control organs is used at least once in the keyway: the first control organ 17, 17' is used for reading the deep control groove 8, 8', the second control organ 18, 18' is used for reading the shallow control grooves 9, 9' and a control organ with a larger diameter 27, 27' is used for reading the control point with a larger diameter 25, 25'.

At least the last sensing position A as seen from the core head of the locking cylinder has the same control organ on both sides. It is thus achieved that the respective other code is not needed and can, therefore, be executed shorter.

In FIGS. 7*a*-7*d* embodiments of keys and locks according to the invention are shown, wherein the length of the shallow control grooves 7, 7' on the key is varied. Correspondingly, the keyway in FIG. 7*d* only has first control organs 17, 17' on both sides at the positions A-E for reading the deep control groove 8, 8'. Solely at the sensing position F, which corresponds to the key tip, also a second control organ 18 is provided for reading the shallow control grooves 9. Furthermore, a control organ with a larger diameter 27, 27' is provided at the sensing position F always on both sides of the keyway for reading a control point with a larger diameter 25, 25'.

Figure 7A:
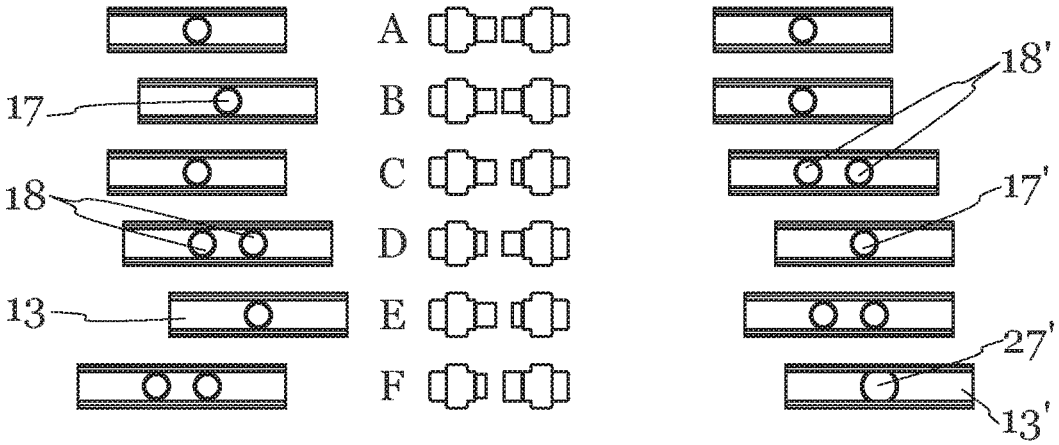
FIGS. 7*a*, 7*b*, 7*c* and 7*d* show further embodiments of keys 1 according to the invention and respective locks.
Figure 7B:
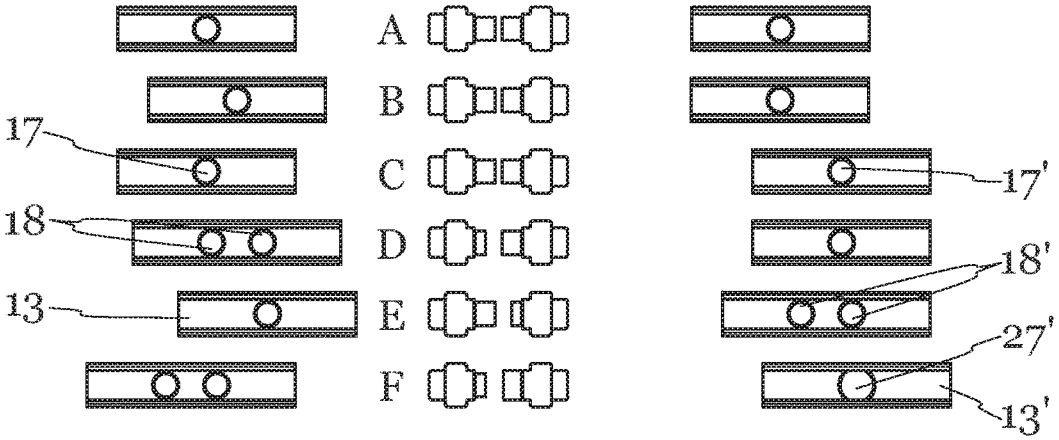
Figure 7C:
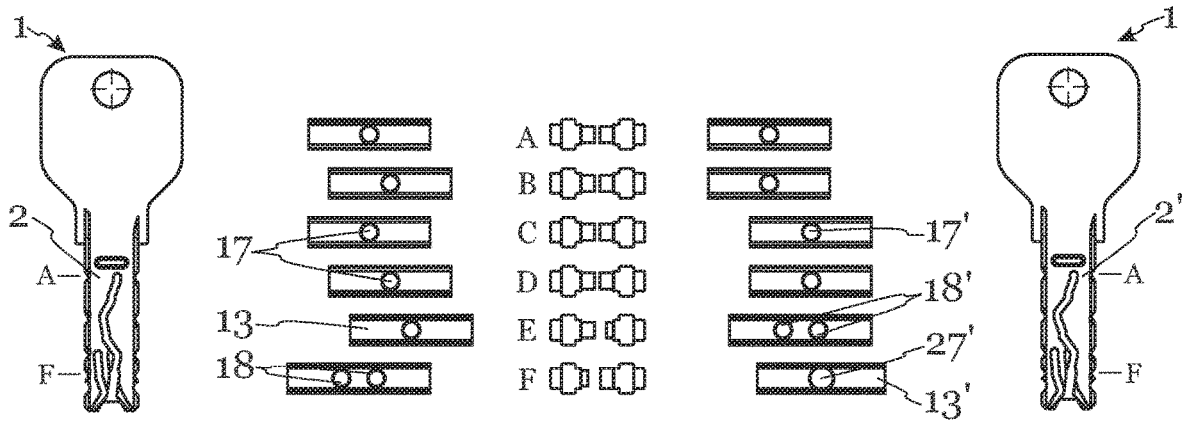
Figure 7D:
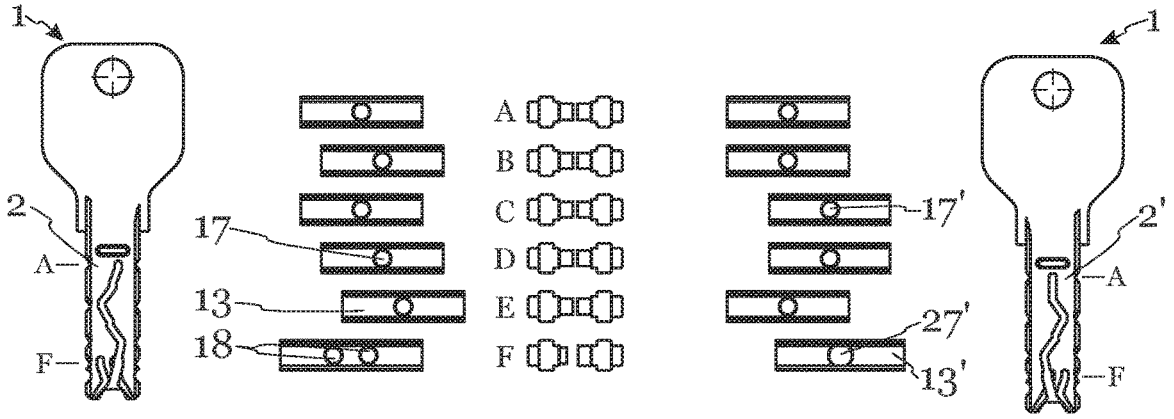

In the exemplary embodiment according to FIG. 7*a* the deep control groove 8, 8' and the shallow control grooves 9, 9' of the key are read alternately at the sensing positions C, D and E. At the sensing positions A and B only the deep control groove 8, 8' is read on both sides. At the sensing position F a control organ with a larger diameter 27' is provided on one side for reading the control point with the larger diameter 25'.

FIGS. 8*a*-8*d* show further embodiments of keys and locks according to the invention. In these figures, embodiments are shown in which the length of the deep control grooves 8, 8' on the key is varied. Correspondingly, the keyway in FIG. 8*d* only has two control organs 18, 18' on both sides at the sensing positions A-D for reading the shallow control groove 7, 7'.

Additionally, a first control organ 17 is provided at the sensing position E, so that each of the three control organs is used at least once also in these exemplary embodiments. Furthermore, a control organ with a larger diameter 27, 27' is always provided on both sides of the keyway at the sensing position F for reading a control point with a larger diameter 25, 25'.

Figure 8A:
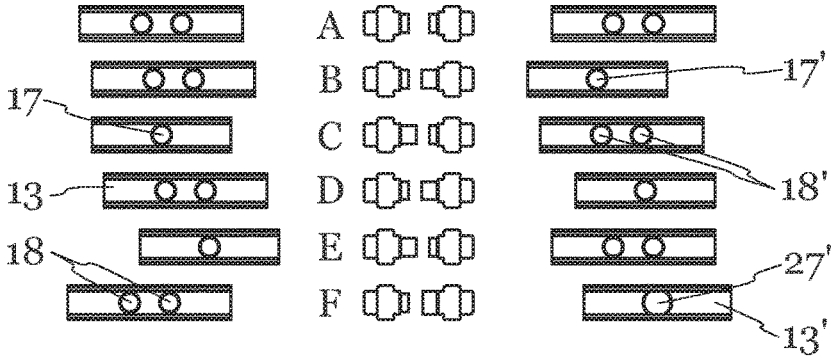
FIGS. 8*a*, 8-8*d* show further embodiments of keys and locks according to the invention.
Figure 8B:
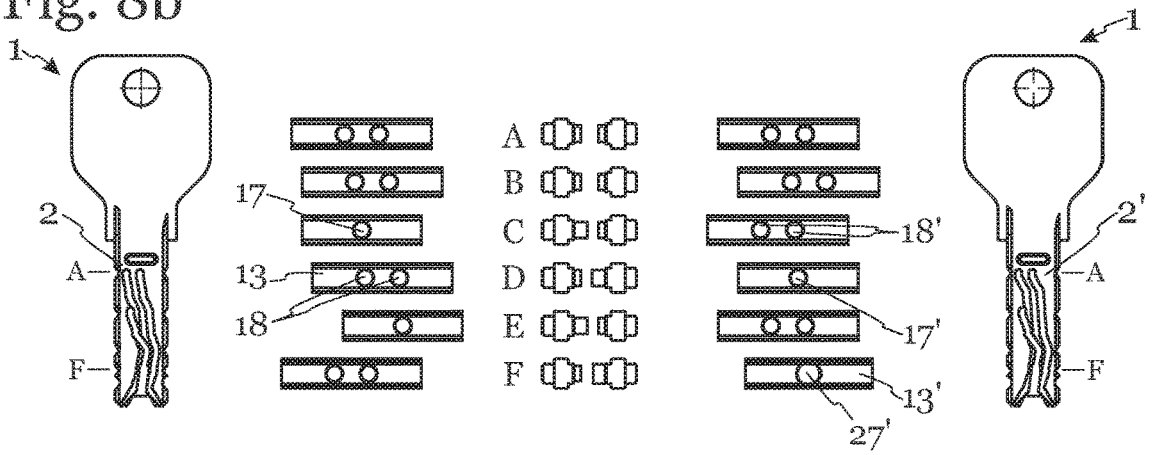
Figure 8C:
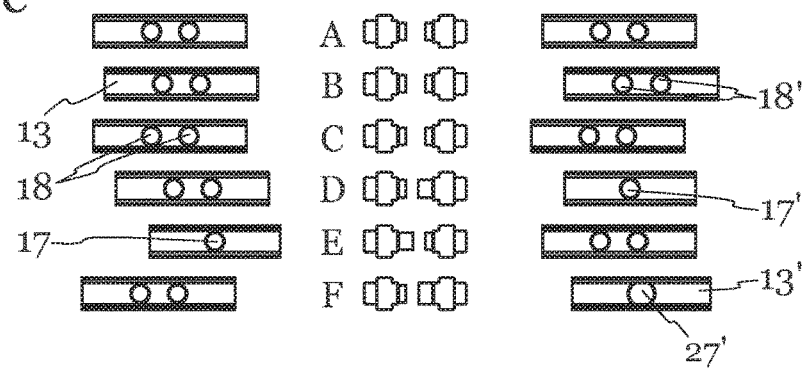
Figure 8D:
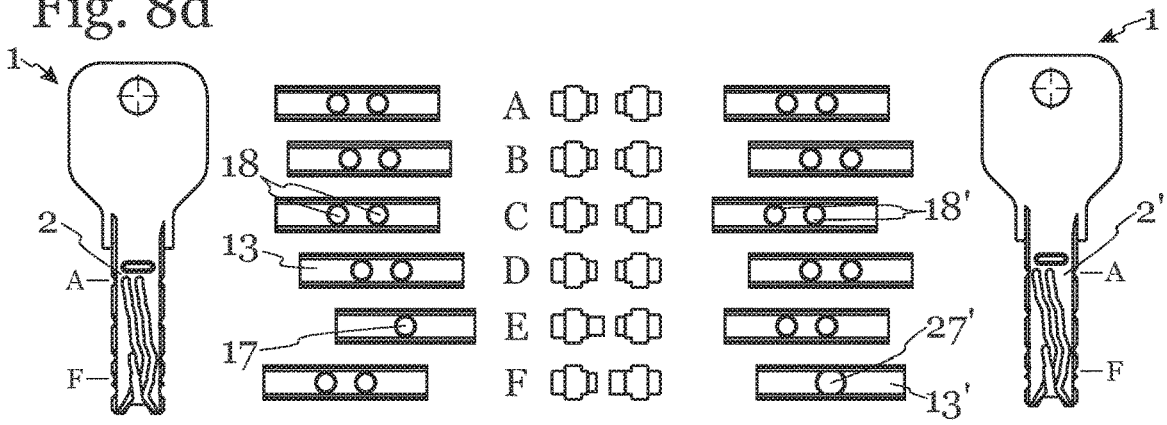

In the exemplary embodiment according to FIG. 8*b*, the deep control groove 8, 8' and the shallow control grooves 9, 9' of the key are read alternately at the sensing positions C, D and E. At the sensing positions A and B only the shallow control grooves 9, 9' are read on both sides. At the sensing position F a control organ with a larger diameter 27' is provided on one side of the keyway 11 for reading the control point with the larger diameter 25'.

The invention is not limited to the illustrated exemplary embodiments, but rather comprises all embodiments in the scope of the patent claims which follow.

REFERENCE LIST

1 Key
2 First surface
2' Second surface
3, 3' Code
4 Sensing position on the key
5 Control height
6, 6' Deep control point
7, 7' Shallow control point
8, 8' Deep control groove
9, 9' Shallow control groove
10 Key bow
11 Keyway
12 Sensing position of the lock
13, 13' Control element
14, 14' Locking element
15, 15' Key narrow side
16, 16' Key flat side
17, 17' First control organ
18, 18' Second control organ
19, 19' Reading groove
20 Key tip
23 Core
24 Housing
25, 25' Control point with larger diameter
26, 26' Deep control groove with larger diameter
27, 27' Control organ with larger diameter
28 Inlet area

What is claimed is:

1. A key for locking a cylinder lock, comprising:

at least one first surface and at least one second surface;

a plurality of sensing positions provided along a longitudinal extent of the key;

at least one code being provided on the first surface; and at least one further code being provided on the second surface;

wherein the codes comprising control points at the plurality of sensing positions provided transversely to the longitudinal extent of the key, arranged at certain control heights and connected by control grooves;

wherein at least three control grooves are provided, of which at least one control groove is constructed as a deep control groove with deep control points, and the remaining control grooves are constructed as shallow control grooves with shallow control points, wherein each of the at least one control groove constructed as said deep control groove having a larger groove depth than the shallow control grooves, and wherein the shallow control grooves extending essentially parallel to one another;

wherein at least one control point is provided with a larger diameter, on the at least first surface and on the at least one second surface at least at one sensing position compared to a control point at another sensing position; and wherein the differently dimensioned control point is part of at least one deep control groove.

2. The key according to claim 1, wherein the codes of the at least first surface and the at least one second surface are different at least at one sensing position, and wherein the codes of the at least first surface and the at least one second surface are identical at least at one sensing position.

3. The key according to claim 1, wherein further codes are provided on the at least first surface and the at least one second surface and/or at other locations on the key.

4. The key according to claim 1, wherein the control points and/or further codes at other locations of the key essentially comprise rectilinear, angled, circular or bent, horizontally or vertically extending grooves, channels, milled sections, notches or elevations, control surfaces, control paths, recesses, drilled recesses with identical or different diameters and/or depths, mounted balls, circular or elliptical segment recesses, spherical-segment-shaped elevations or recesses, magnetic codes, electronic codes and/or combinations of these elements.

5. The key according to claim 1, wherein the at least first surface and the at least one second surface are key flat sides.

6. The key according to claim 1, wherein the at least first surface and the at least one second surface are key narrow sides.

7. The key according to claim 1, wherein the first surface is a key narrow side and the second surface is a key flat side.

8. The key according to claim 1, wherein at least six sensing positions are provided in the longitudinal direction of the key and at least six control heights are provided in a transverse direction of the key.

9. The key according to claim 1, wherein at least three control heights are provided for at least one control groove.

10. The key according to claim 1 with a key tip and a key bow, wherein the code on the at least first surface and the code on the at least one second surface having a first portion which is identical and is positioned starting from the key tip in a direction of the key bow, and having a second portion which is non-identical and is positioned from a certain sensing position onwards toward the key bow.

11. The key according to claim 1 with a key tip and a key bow, wherein at least one control groove is constructed as a deep control groove, wherein some other control grooves are constructed as shallow control grooves, wherein said at least one control groove constructed as said deep control groove or said some other control grooves constructed as said shallow control grooves are positioned starting from the key tip in a direction of the key bow and only extend up to a certain sensing position, while other control grooves not constructed as deep control grooves or shallow control grooves extend beyond said certain sensing position.

12. The key according to claim 1 with a key tip and a key bow, wherein the differently dimensioned control point is arranged at the first sensing position proximal to the key tip.

13. The key according to claim 1, wherein the differently dimensioned control point has a diameter that is about 10% to about 40% larger than the diameter of the other control points.

14. The key according to claim 1, wherein each of the at least one control groove constructed as said deep control groove at the key tip is arranged between the shallow control grooves and merge with them, wherein no separating material bar remains at the key tip between the at least one control groove constructed as said deep control groove and the shallow control grooves so that two control grooves allow an allocation of three different control organs of a lock to three corresponding control grooves.

15. The key according to claim 1, wherein the at least one control groove constructed as said deep control groove connects a tip of the key to a first control point having said larger diameter, said at least one control groove constructed as said deep control groove having a diameter similar to said larger diameter and is connected to said key tip in a funnel shaped opening with a funnel wide opening at said key tip side.

16. A cylinder lock for a key according to claim 1, comprising:

a keyway with at least two sides;

a plurality of sensing positions provided along a longitudinal extent of the keyway;

wherein at least one control element with control organs for engaging at least one code on at least one surface of the key is provided at each sensing position;

wherein at least one locking element is provided, which, given an appropriate position of the control element, can be brought into a release position for actuating the lock;

wherein the control elements comprise first control organs for engaging deep control grooves and second control organs for engaging shallow control grooves; and wherein the control organs are provided with a larger width, at least at one sensing position, compared to the other sensing positions, for engaging control points with a larger diameter.

17. The cylinder lock according to claim 16, wherein control elements for reading different codes on two surfaces of the key are provided at least at one first sensing position on two sides of the keyway, and wherein control elements for reading identical codes on two surfaces of the key are provided at least at one second sensing position on two sides of the keyway.

18. The cylinder lock according to claim 17, wherein the control elements for controlling the locking elements have engaging means, particularly one or more reading grooves, which interact with the locking element in one or more positions of the control element in such a manner that the same can be brought into a release position for actuating the lock.

19. The cylinder lock according to claim 16, wherein the differently dimensioned control organs are arranged at the last sensing position as seen from a core head of the cylinder lock.

20. A system made up of at least two locks and at least one associated key according to claim 1, wherein:

a. at least one first lock or a first lock group reads at least only the first code on the first surface at least at one specific sensing position, and b. at least one second lock or a second lock group reads at least only a second code on the second surface of the key at the same sensing position, c. wherein the at least one associated key locks the first lock in a first position and the second lock in a second position.

* * * * *